United States Patent [19]

Kashiwagi et al.

[11] Patent Number: 4,640,999

[45] Date of Patent: Feb. 3, 1987

[54] CONTACT MATERIAL OF VACUUM INTERRUPTER AND MANUFACTURING PROCESS THEREFOR

[75] Inventors: Yoshiyuki Kashiwagi; Yasushi Noda, both of Tokyo; Kaoru Kitakizaki, Higashimine, all of Japan

[73] Assignee: Kabushiki Kaisha Meidensha, Japan

[21] Appl. No.: 521,172

[22] Filed: Aug. 8, 1983

[30] Foreign Application Priority Data

| | | | |
|---|---|---|---|
| Aug. 9, 1982 | [JP] | Japan | 57-138331 |
| Jun. 22, 1983 | [JP] | Japan | 58-113290 |
| Jun. 22, 1983 | [JP] | Japan | 58-113291 |

[51] Int. Cl.[4] ..... H01H 33/66

[52] U.S. Cl. ..... 200/144 B; 200/266; 428/569

[58] Field of Search ..... 200/144 B

[56] References Cited

U.S. PATENT DOCUMENTS

| | | | |
|---|---|---|---|
| 3,246,979 | 4/1966 | Lafferty et al. | 200/144 B |
| 3,596,027 | 7/1971 | Okutomi et al. | 200/144 B |
| 3,811,939 | 5/1974 | Hassler et al. | 117/227 |
| 3,818,163 | 6/1974 | Robinson | 200/144 B |
| 3,828,428 | 8/1974 | Wayland | 200/266 |
| 4,302,514 | 11/1981 | Kato et al. | 428/569 |
| 4,323,590 | 4/1982 | Lipperts | 200/144 B |
| 4,486,631 | 12/1984 | Naya et al. | 200/144 B |

FOREIGN PATENT DOCUMENTS

| | | |
|---|---|---|
| 83245 | 7/1983 | European Pat. Off. . |
| 2101414 | 8/1972 | Fed. Rep. of Germany . |

*Primary Examiner*—Robert S. Macon

*Attorney, Agent, or Firm*—Lowe, Price, Leblanc, Becker & Shur

[57] ABSTRACT

Contact materials of a vacuum interrupter and producing process therefor are disclosed. The contact materials provide a contact which is much high in relatively large current and small lagging and leading current interrupting capabilities and dielectric strength while a little in an anti-welding capability down. The contact materials are composed of between 20 and 70 weight % copper, between 5 and 70 weight % molybdenum and between 5 and 70 weight % chromium. The contact material is produced by diffusion bonding a mixture of molybdenum powder and chromium powder into a porous matrix and infiltrating the matrix with copper. Alternatively, the contact materials may be produced by sintering a mixture of three metal powders.

8 Claims, 13 Drawing Figures

CONTACT MATERIAL OF VACUUM INTERRUPTER AND MANUFACTURING PROCESS THEREFOR

BACKGROUND OF THE INVENTION

1. Field of the Invention

The present invention relates to contact materials for vacuum interrupters and to manufacturing processes therefor.

2. Description of the Prior Art

Generally, contact materials for vacuum interrupters are required to consistently satisfy the following requirements:

(a) highness in relatively large current, for example a fault current, interrupting capability, (b) highness in dielectric strength, (c) highness in anti-welding capability, (d) highness in relative small leading and lagging current interrupting capability, (e) current chopping value as small as possible.

However, contact materials to consistently satisfy all the requirements, in the present state of the art, have not been provided.

For instance, various contacts made of copper as a major constituent containing a minor constituent of a low melting point and high vapor-pressure material, such as a contact made of copper containing a 0.5 weight % bismuth (hereinafter, referred to as a Cu-0.5 Bi contact) that is disclosed by the U.S. Pat. No. 3,246,979, or a contact that is disclosed by the U.S. Pat. No. 3,596,027, are known.

Contacts made of copper containing a minor constituent of material of a low melting point and high vapor pressure such as, for example, the Cu-0.5 Bi contact, are relatively large in large current interrupting capability, electrical conductivity and anti-welding capability they are, however significantly low in dielectric strength, particularly in dielectric strength after large current interruption.

In particular, a current chopping value of a pair of the Cu-0.5 Bi contacts amounts to 10A, being relatively large, so that it happens to cause a chopping surge in current interruption. Thus, a pair of the Cu-0.5 Bi contacts are low in interrupting capability of relatively small lagging current, which happens to lead to dielectric breakdown of electrical devices of load circuits.

To eliminate the drawbacks of the abovedescribed contacts, various contacts made of an alloy consisting of copper and material of high melting point and low vapor pressure, such as a contact of an alloy consisting of 20 weight % copper and 80 weight % tungsten (hereinafter, referred to as a 20Cu-80 W contact) that is disclosed by the U.S. Pat. No. 3,811,939, or a contact that is disclosed by U.K. Pat. No. 2,024,257A, are provided.

Such contacts made of an alloy consisting of copper and material of high melting point and low vapor pressure, for example, the 20Cu-80 W contact, are relatively high in dielectric strength; however, they are relatively low in large current interrupting capability.

Consequently, it is found that to increase current interrupting capability and high withstanding voltage for a vacuum interrupter will be difficult unless novel materials are provided.

SUMMARY OF THE INVENTION

An object of the present invention is to provide contact materials of a vacuum interrupter which, while maintaining good anti-welding capability, enhances the interrupting capability of large and small currents, and provides, in particular, more dielectric strength. The present contact materials are made of a metal composition consisting of between 20 and 70 weight % copper, between 5 and 70 weight % molybdenum and between 5 and 70 weight % chromium. With reference to the Cu-0.5 Bi contact, the dielectric strength of the present contact material is more than 3 times as high, the current chopping value thereof between $\frac{1}{3}$ and the $\frac{1}{2}$, and interruptable charging current for capacitance load or line is 2 times as high. While, with reference to the contact made of copper containing material of high melting point and low vapor pressure, such as for example, the 20Cu-80 W contact, the large current interrupting capability of the present contact material is high, the anti-welding capability thereof is down between 20 and 30%. Such downward capability will be offset by some increased tripping force on contact opening.

Another object of the present invention is to provide a manufacturing process for making a contact material of a vacuum interrupter, which manufacturing process is generally divided into an infiltrating or a sintering process.

The infiltrating process includes the two steps: (1) diffusively bonding a mixture of molybdenum powder and chromium powder into a porous matrix under non-oxidizing atmosphere; and (2) infiltrating the porous matrix with copper under non-oxidizing atmosphere.

The sintering process includes the two steps: (1) pressing a mixture of molybdenum powder chromium powder and copper powder into a green compact; and (2) sintering the green compact under non-oxidizing atmosphere.

Generally, the present invention intends to metallurgically compose the three elements of copper, chromium and molybdenum, thus offsetting drawbacks of each element and using the advantages of each element among the other so that the metal composition of the elements can satisfy the requirements for a contact material of the vacuum interrupter. It is found in the concept of the present invention that copper contributes to enhance current interrupting capability and electrical conductivity but reduces dielectric strength; that chromium to enhances dielectric strength and reduces current chopping value but also significantly reduces electrical conductivity; that molybdenum enhances dielectric strength and brittleness but increases current chopping value; and that, metallurgically, copper has little affinity with each of molybdenum and chromium but that molybdenum and chromium have much affinity therebetween. These facts lead to the present invention.

Other objects and advantages of the present invention will be apparent from the following description, claims and attached drawing and photographs.

BRIEF DESCRIPTION OF THE DRAWINGS

FIGS. 2A to 2D all are photographs by an X-ray microanalyzer of a structure of the first embodiment of the contact material, in which FIG. 2A is a secondary electron image photograph of the material structure, FIG. 2B is a characteristic X-ray image photograph of molybdenum of the material structure, FIG. 2C is a characteristic X-ray image photograph of chromium of the material structure, and FIG. 2D is a characteristic X-ray image photograph of copper of the material structure;

FIGS. 3A to 3D all are photographs by the X-ray microanalyzer of a structure of the second embodiment of the contact material, in which FIG. 3A is a secondary electron image photograph of the material structure, FIG. 3B is a characteristic X-ray image photograph of molybdenum of the material structure, FIG. 3C is a characteristic X-ray image photograph of chromium of the material structure, and FIG. 3D is a characteristic X-ray image photograph of copper of the material structure;

FIGS. 4A to 4D all are photographs by the X-ray microanalyzer of a structure of the third embodiment of the contact material, in which FIG. 4A is a secondary electron image photograph of the material structure, FIG. 4B is a characteristic X-ray image photograph of molybdenum of the material structure, FIG. 4C is a characteristic X-ray image photograph of chromium of the material structure, and FIG. 4D is a characteristic X-ray image photograph of copper of the material structure.

DESCRIPTION OF THE PREFERRED EMBODIMENTS

The preferred embodiments of the present invention will be described in conjunction with the attached drawing and photographs.

Figure 1:
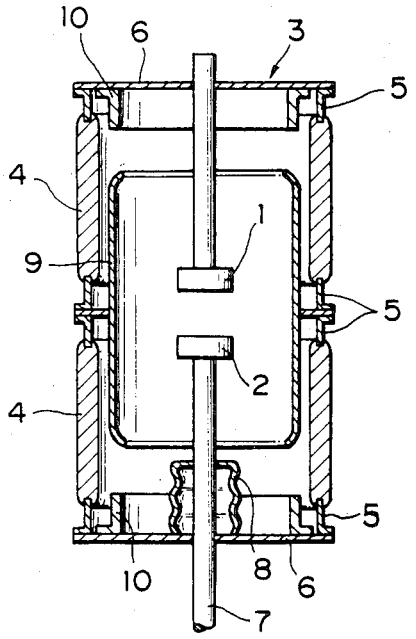
FIG. 1 is a longitudinal section of a vacuum interrupter including a pair of cooperating contacts made of material according to the present invention.

As shown in FIG. 1, a vacuum interrupter includes a pair of stationary and movable contacts 1 and 2, made of the contact material of the present invention, within the vacuum envelope 3. The major portion of the vacuum envelope 3 comprises two insulating cylinders 4 made of insulating glass or ceramics which are in series associated with each other, four sealing metal-fittings 5, e.g., made of a Fe-Ni-Co alloy which are of a thin-walled-cylindrical shape and attached to both the ends of each insulating cylinder 4, two metal end discs 6 each hermetically connected to each insulating cylinder 4 via each sealing metal-fitting 5 at the outer edges of both the insulating cylinders 4, and metal bellows 8 hermetically maintaining an interspace between a movable lead rod 7 attached to the movable contact 2 and one of the metal end discs 6.

A cylindrical metal shield 9 which is supported by the two sealing metal-fittings 5 at the inner edges of both the insulating cylinders 4 is provided between the stationary and movable contacts 1 and 2 and the insulating cylinders 4 in series connected to each other. The metal shield 9 serves to prevent a metal vapor, generated from the stationary and movable contacts 1 and 2 engaging or disengaging from each other, from precipitating on the inner surface of each insulating cylinder 4.

Each metal end disc 6 is provided on its inner surface with an auxiliary annular shield 10 which serves to modify a concentration of electrical field at a connection between each sealing metal-fitting 5 and insulating cylinder 4.

The stationary and movable contacts 1 and 2 are made of a metal composition consisting of between 20 and 70 weight % copper, between 5 and 70 weight % molybdenum and between 5 and 70 weight % chromium.

The structural property of the contact material therefore depends on the manufacturing process. One of the processes (hereinafter, refer to as an infiltrating process) comprises a step of diffusively bonding a mixture of molybdenum powder and chromium powder into a porous matrix and a step of infiltrating the matrix with copper.

Another of the processes (hereinafter, refer to as a sintering process) comprises a step of pressing a mixture of copper powder, molybdenum powder and chromium powder into a green compact and a step of sintering the green compact at a temperature below the melting point (1875° C.) of chromium.

First, contact materials in the infiltrating process will be described. A structure of the contact materials consists of a porous matrix in which no more than 100 mesh (at Tyler system, i.e., no more than 149 μm at JIS, hereinafter refer to as minus 100 mesh) molybdenum powder of between 5 and 70 weight % and minus 100 mesh chromium powder of between 5 and 70 weight % diffuse into each other and into an infiltrating copper of between 20 and 70 weight %.

The contact materials are produced in accordance with the following processes. Both the metal powders of minus 100 meshes were used.

First, a certain amount (e.g., an amount of one final contact plus a machining margin) of molybdenum powder and chromium powder which are respectively prepared between 5 and 70 weight % and between 5 and 70 weight % but in total between 30 and 80 weight % at a final ratio, are mechanically and uniformly mixed.

Second, the resulting mixture of the powders is thrown into a vessel of a circular section made of material, e.g., alumina ceramics which react on none of molybdenum, chromium and copper. A solid copper is placed on the mixture of the powders.

Third, the mixture of the powders and solid copper is heat held under a non-oxidizing atmosphere, e.g., a vacuum of a pressure of at highest $5\times10^{-5}$ Torr at a temperature of below melting point (1083° C.) of copper, e.g., between 600° and 1000° C. during a fixed period, e.g., about between 5 and 60 minutes, to diffusively bond the molybdenum powder and chromium powder (hereinafter, refer to as a molybdenum-chromium diffusion step). Thus, the molybdenum-chromium diffusion step performed, the resulting matrix consisting of molybdenum and chromium and the solid copper are heat held under a non-oxidizing atmosphere, e.g., a vacuum of a pressure of at highest $5\times10^{-5}$ Torr at a temperature of at least a melting point of the porous matrix, e.g., 1100° C. during about between 5 and 20 minutes, which leads to an infiltrating of the porous matrix with molten copper (hereinafter, refer to as a copper infiltrating step). After cooling, the desired contact material was obtained.

THE SECOND INFILTRATING PROCESS

First, molybdenum powder and chromium powder are mechanically and uniformly mixed as in the first infiltrating process.

Second, the resulting mixture of the powders is thrown in the same vessel as that in the first infiltrating process. The mixture of the powders is heat held under a non-oxidizing atmosphere, e.g., a vacuum of a pressure of at highest $5\times10^{-5}$ Torr or a hydrogen, nitrogen or an argon gas at a temperature below a melting point of chromium, e.g., a temperature between 600° and 1000° C. during a fixed time, e.g., about between 5 and 60 minutes, thus diffusively bonding into a porous matrix.

Third, under the same or another non-oxidizing atmosphere, e.g., a vacuum of a pressure of at highest $5\times10^{-5}$ Torr, as that of the step of diffusively bonding the molybdenum powder and chromium powder, a solid copper is placed on the porous matrix, and the porous matrix and solid copper are heat held at a temperature of at least the melting point of copper but lower than a melting point of the porous matrix during about between 5 and 20 minutes, thus the copper infiltrating step is performed.

In the second infiltrating process, the solid copper is not placed in the vessel in the molybdenum-chromium diffusion step, so that the mixture of molybdenum powder and chromium powder can be heat held into the porous matrix at a temperature of at least the melting point (1083° C.) of copper unless exceeding the melting point (1875° C.) of chromium.

In the second infiltrating process too, the molybdenum-chromium diffusion step may be performed under various non-oxidizing atmospheres, e.g., hydrogen gas, nitrogen gas and argon gas, and the copper infiltrating step under an evacuation to vacuum degassing the contact material.

In particular, a columnar porous matrix many times as long as a disc-shaped contact may be produced in the molybdenum-chromium diffusion step under various non-oxidizing atmospheres, the columnar porous matrix cut in the desired thickness and shape and then machined into a disc-shaped porous matrix corresponding to one contact, and the porous matrix subject to the copper infiltrating step under evacuation to vacuum. Thus, the desired contact material may be obtained.

In the infiltrating processes, a vacuum is preferably selected, but not other non-oxidizing atmosphere as a non-oxidizing atmosphere because degassing of contact material can be concurrently performed during heat holding. However, even if deoxidizing gas or inert gas is employed as a non-oxidizing atmosphere, the obtained contact material still has no failure as a contact of a vacuum interrupter.

In addition, the heat holding temperature and period for the molybdenum-chromium diffusion step is determined on the basis of taking into account the conditions of a vacuum furnace or other gas furnaces, the shape and size of a porous matrix to produce and the workability so that the desired properties as a contact material will be satisfied. For instance, a heating temperature of 600° C. determines a heat holding time of 60 minutes or a heating temperature of 1000° C. determines a heat holding time of 5 minutes.

Particle size of molybdenum powder and chromium powder may be minus 60 meshes, i.e., no more than 250 μm. However, the upper limit of the particle size lowering, it is generally more difficult to uniformly mix the metal powders, i.e., to uniformly distribute each metal particle. Further, it is more complicated to handle the metal powders and they, when used, necessitate a pretreatment because they are more liable to be oxidized.

If the particle size of each metal powder exceeds 60 meshes, it is necessary to make the heating temperature higher or make the heating period of time longer with a diffusion distance increasing, which leads to lowering productivity of the molybdenum-chromium diffusion step. Consequently, the upper limit of the particle size of each metal powder is determined in view of various conditions. According to the infiltrating processes, it is because the particles of molybdenum and chromium can be more uniformly distributed to cause better diffusion bonding of the metal powders, thus resulting in contact material having better properties, that the particle size of each metal powder is determined the minus 100 meshes. If molybdenum particles and chromium particles are badly distributed, then drawbacks of both metals will not be offset by each other and advantages thereof will not be developed. In particular, the more the size of a particle of each metal exceeds minus 60 meshes, the significantly much more becomes the proportion of copper in a surface of a contact which contributes to lower dielectric strength, or molybdenum, chromium and molybdenum-chromium alloy particles which have been granulated larger appear in the surface of the contact, so that the drawbacks of the respective molybdenum, chromium and copper metals become more apparent but not the advantages thereof.

Structures of metal compositions, according to embodiments of contact material in the first infiltrating process above-described (however, under a non-oxidizing atmosphere of the vacuum of a pressure of $5\times10^{-5}$ Torr), will be described hereinafter with reference to FIGS. 2A to 2D, FIGS. 3A to 3D and FIGS. 4A to 4D which are all produced by an X-ray microanalyzer.

The first embodiment of contact material has a composition consisting of 40 weight % molybdenum 10 weight % chromium and 50 weight % copper.

Figure 2A:
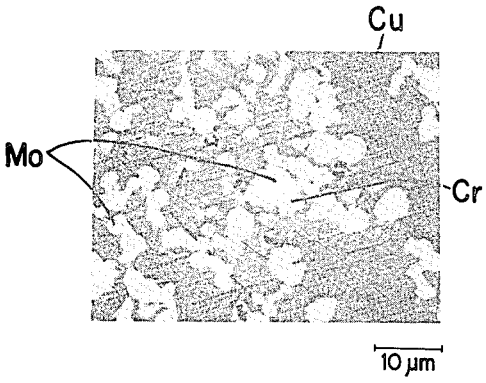
Figure 2B:
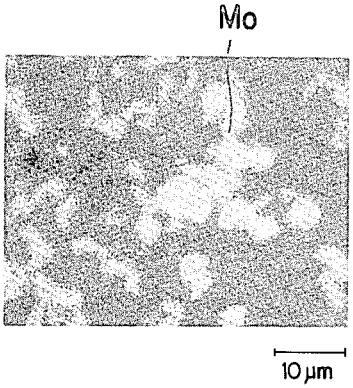
Figure 2C:
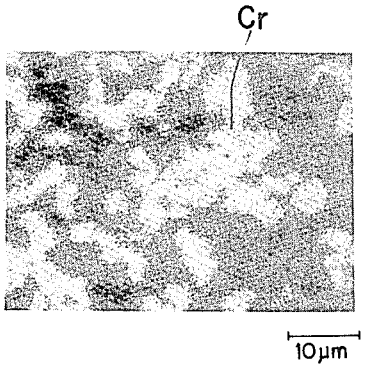
Figure 2D:
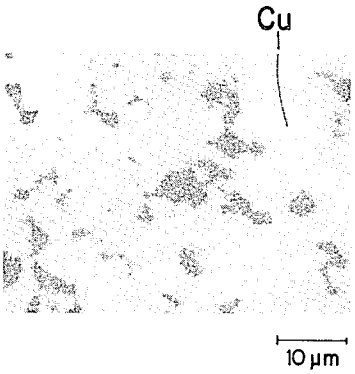

FIG. 2A is a secondary electron image photograph of the material structure in accordance with the first embodiment of contact material. FIG. 2B is a characteristic X-ray image photograph of scattered molybdenum particles, in which scattered insular portions indicate molybdenum. FIG. 2C is a characteristic X-ray image photograph of scattered chromium particles, in which scattered insular portions indicate chromium. FIG. 2D is a characteristic X-ray image photograph of infiltrated copper, in which white portions indicate copper.

As apparent from the FIGS. 2A to 2D, molybdenum powder and chromium powder are uniformly scattered throughout the material structure and diffusively bonded with each other into many insular portions integrally granulated larger than particles of molybdenum and chromium. The insular portions are firmly and uniformly associated with each other throughout the material structure into the porous matrix. The interstices of the porous matrix are infiltrated with copper.

The second embodiment of contact material has a composition consisting of 25 weight % molybdenum, 25 weight % chromium and 50 weight % copper.

Figure 3A:
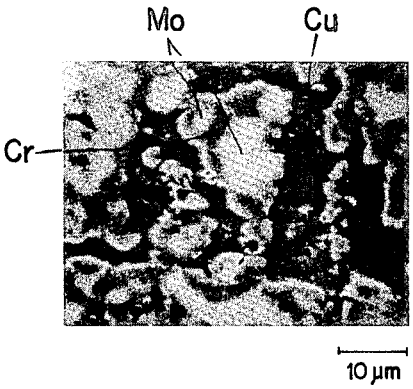
Figure 3B:
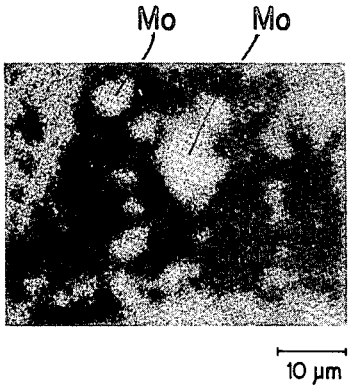
Figure 3C:
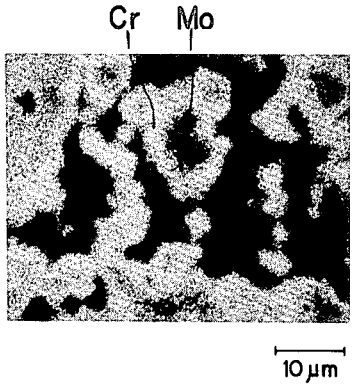
Figure 3D:
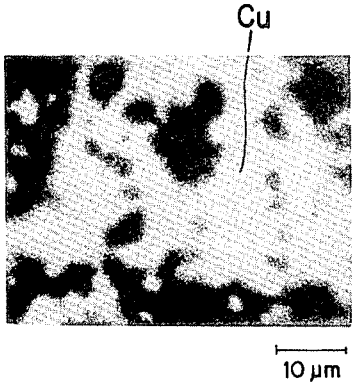

FIG. 3A is a secondary electron image photograph of the material structure in accordance with the second embodiment of contact material. FIG. 3B is a characteristic X-ray image photograph of scattered molybdenum particles, in which scattered insular portions indicate molybdenum. FIG. 3C is a characteristic X-ray image photograph of scattered chromium particles, in which insular portions bordered with white layers indicate chromium. The insular portions consist of gray portions into which molybdenum and chromium are uniformly diffusively bonded, white chromium rich portions and white molybdenum rich portions. FIG. 3D is a characteristic X-ray image photograph of infiltrated copper, in which white portions indicate copper.

As apparent from the FIGS. 3A to 3D, molybdenum powder and chromium powder, the former entering more inwardly than the latter, form molybdenum rich portions and relatively thin outer chromium layers around them to establish many larger insular particles firmly associated with each other.

The molybdenum powder and chromium powder also form many insular particles the same as the insular particles in FIGS. 2A to 2D.

Such two kinds of insular particles are firmly and uniformly associated with each other throughout the material structure into the porous matrix. The interstices of the porous matrix are infiltrated with copper.

The third embodiment of contact material has a composition consisting of 10 weight % molybdenum, 40 weight % chromium and 50 weight % copper.

Figure 4A:
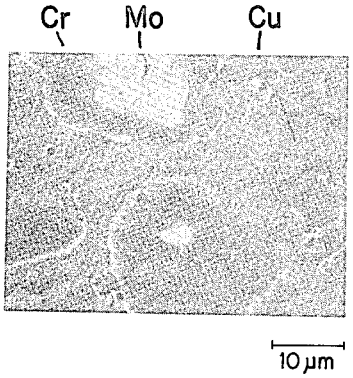
Figure 4B:
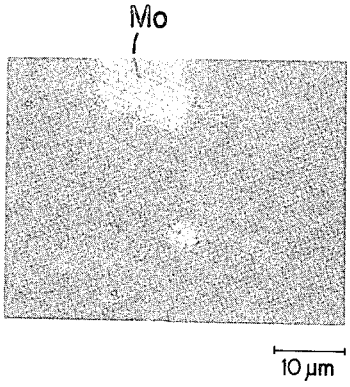
Figure 4C:
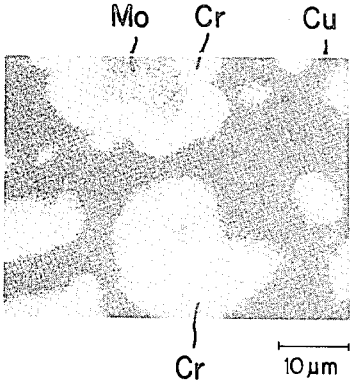
Figure 4D:
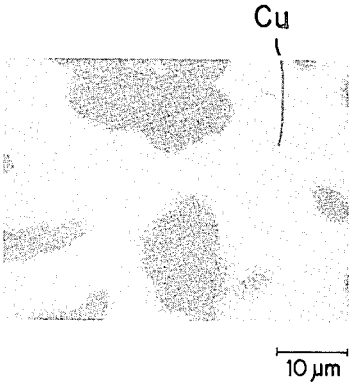

FIG. 4A is a secondary electron image photograph of the material structure in accordance with the third embodiment of contact material. FIG. 4B is a characteristic X-ray image photograph of scattered molybdenum particles, in which scattered insular portions indicate molybdenum. FIG. 4C is a characteristic X-ray image photograph of scattered chromium particles, in which many white portions insularly scattered indicate chromium. Gray portions inside some of the white portions indicate molybdenum rich portions. FIG. 4D is a characteristic X-ray image photograph of the infiltrating copper, in which white portions indicate copper.

As apparent from the FIGS. 4A to 4D, molybdenum powder and chromium powder, the former entering more inwardly than the latter, form molybdenum rich portions and relatively thick outer chromium layers around them to establish many larger insular particles firmly associated with each other. The insular particles consisting of molybdenum and chromium particles and insular particles of chromium particles alone are uniformly and firmly associated with each other throughout the material structure into the porous matrix. The interstices of the porous matrix are infiltrated with copper.

The first, second and third embodiments of contact material above-shown and above-described are shaped into a disc-shaped contact of diameter 50 mm, thickness 6.5 mm and radius of roundness 4 mm in the periphery. A pair of these contacts was assembled into the vacuum interrupter illustrated in FIG. 1. Tests were carried out on the performances of the vacuum interrupter and also carried out on electrical conductivity and hardness of contact material itself. The results of the tests will be described. A description of the contact of the first embodiment of contact material shall be made and where performances of contacts of the second and third embodied contact materials are different from those of the contact of the first embodied contact material, the different points shall be specified at a convenient point.

(1) Relatively large current interrupting capability.

Current of 12 kArms was interrupted.

(2) Dielectric strength

In accordance with the JEC187 test method, a withstand voltage impulse test was carried out with a 3.0 mm inter-contact gap. Results showed a withstand voltage of 120 kV against both negative and positive impulses with a scatter of ±10 kV.

After interrupting 12 kArms current, the same impulse withstand voltage test was carried out and showed the same result.

After many times continuously opening and closing a circuit through which 80 Arms relatively small leading current flows, the same impulse withstand voltage test was carried out and showed the same result.

In addition, both the contacts of the second and third embodied contact materials showed a positive 110 kV and a negative 120 kV withstand voltage with the 3.0 mm inter-contact gap.

(3) Anti-welding capability

In accordance with the IEC short time current standard, both the stationary and movable contacts 1 and 2 were forced to contact each other under a 130 kgf force, thus flowing 25 kArms current therethrough for 3 seconds. The contacts 1 and 2 were then disengaged from each other without any failures with a 200 kgf static disengaging force. An increase of contacting electrical resistance after that stayed within a 2 to 8 percent range.

In accordance with the IEC short time current standard, both the contacts 1 and 2 were also forced to contact each other under a 1,000 kgf force, thus flowing 50 kArms current therethrough for 3 seconds. The contacts 1 and 2 were then disengaged from each other without any failure with the 200 kgf static disengaging force. An increase of contacting electrical resistance after that stayed within a 0 to 5 percent range. Thus, the contacts 1 and 2 have an actually good anti-welding capability.

(4) Relatively small laggging current interrupting capabity

In accordance with a JEC181 relatively small lagging current interrupting test standard, a 30 Arms test current was flowed through the contacts 1 and 2. The average of current chopping value was 3.9 A (however, a deviation $\sigma n=0.96$ and a sample number $n=100$).

In addition the averages of, current chopping values of the contacts of the second and third embodiment contact materials were 3.7 A (however, $\sigma n=1.26$ and $n=100$) and 3.9 A (however, $\sigma n=1.5$ and $n=100$) respectively.

(5) Relatively small leading current interrupting capability

In accordance with a JEC181 relatively small leading current interrupting test standard, a relatively small leading current interrupting test standard, a relatively small leading test current of $$84\text{ kV} \times \frac{1.25}{\sqrt{3}}$$

and 80 Arms was flowed through the contacts 1 and 2. In that condition a 10,000 times continuously opening and closing test was carried out. No reignition was created.

(6) Electrical conductivity

Percent electrical conductivity (however, with reference to IACS) was between 20 and 50%.

(7) Hardness

Measured under a 1 kgf load, Vickers hardness Hv was between 106 and 182.

As apparent from the items (1) to (7), the pair of the contacts of the first, second and third embodied contact materials has excellent properties with reference to the requirements for a contact of a vacuum interrupter. The compared results will be described between the properties of the vacuum interrupter including the pair of the contacts of the first embodied contact material and those of a vacuum interrupter including a pair of the same shaped Cu-0.5 Bi contacts.

(i) Relatively large current interrupting capability

Both the vacuum interrupters have equal capabilities.

(ii) Dielectric strength

The impulse withstand voltage which the contacts of the first embodied contact material had at the 3.0 mm inter-contact gap was equal to that which the Cu-0.5 Bi contacts had at the 10 mm inter-contact gap. Thus, the contacts of the first embodied contact material have a dielectric strength a little higher than 3 times dielectric strength of the Cu-0.5 Bi contacts.

(iii) Anti-welding capability

The anti-welding capability of the contacts of the first embodied contact material amounts to an 80% anti-welding capability of the Cu-0.5 Bi contact. However, such down is not significant actually. If necesary, a contact disengaging force may be a little enhanced.

(iv) Relatively small lagging current interrupting capability

The current chopping value of the contacts of the first embodied contact material still amounts to a 40% current chopping value of the Cu-0.5 Bi contact, so that a chopping surge is almost not significant. It is also stable even after many times engaging and disengaging of the contacts for interrupting small lagging current.

(v) Relatively small leading current interrupting capability

The contacts of the first embodied contact material interrupted 2 times capacitance load or line charging current of the Cu-0.5 Bi contacts.

The contacts of the second and third embodied contact materials showed substantially the same results as those of the first embodied contact material with reference to the Cu-0.5 Bi contact.

The following limits were apparent on a composition ratio of each metal in the contact material by the infiltrating process.

Below 5 weight % molybdenum significantly lowered dielectric strength, while above 70 weight % molybdenum lowered relatively large current interrupting capability.

Below 5 weight % chromium significantly increased current chopping value, while above 70 weight % chromium lowered relatively large current interrupting capability.

Below 20 weight % copper significantly lowered electrical conductivity of the contact itself, while it increased contacting electrical resistance after the short time current test, so that Joule heating volume will significantly increase during rated current flowing. Thus, the utility of a contact of below 20 weight % copper was significantly lowered. While, above 70 weight % copper significantly lowered dielectric strength.

Now, contact material by a sintering process will be hereinafter described. The contact material has a composition in which is sintered a mixture of minus 100 mesh copper powder between 20 and 70 weight %, minus 100 mesh molybdenum powder between 5 and 70 weight %, and minus 100 mesh chromium powder between 5 and 70 weight %.

The contact materials are produced in accordance with the following processes. All of the metal powders of minus 100 meshes were used.

First, copper powder and molybdenum powder and chromium powder, which are prepared as in the first infiltrating process, are mechanically and uniformly mixed.

Second, the obtained mixture of the powders is thrown in a predetermined vessel and pressed into a green compact under the fixed pressure, e.g., between 2,000 and 5,000 kgf/cm$^2$.

Third, the obtained green compact which is taken out of the vessel is heat held under a non-oxidizing atmosphere, e.g., a vacuum of a pressure of at highest $5\times10^{-5}$ Torr or a hydrogen, nitrogen or an argon gas at a temperature below the melting point (1083° C.) of copper during a fixed time, e.g., about between 5 and 60 minutes, and thus sintered into contact material of metal composition.

The second sintering process is different from the first sintering process in that the green compact is sintered at a temperature of at least the melting point of copper but below the melting point of chromium.

In the sintering processes, a vacuum is preferably selected, but not other non-oxidizing atmosphere as a non-oxidizing atmospere, the same as the non-oxidizing atmosphere in the infiltrating process, because degassing of contact material can be concurrently performed during heat holding. However, even if deoxidizing gas or inert gas is employed as a non-oxidizing atmosphere, the obtained contact material still has no failure as a contact of a vacuum interrupter.

In addition, the heat holding temperature and period for sintering the green compact is determined on the basis of taking into account the conditions of a vacuum furnace or other gas furnaces, the shape and size of contact material to produce and the workability so that desired properties as contact material will be satisfied. For instance, a heating temperature of 600° C. determines a heat holding time of 60 minutes or a heating temperature of 1000° C. determines a heat holding time of 5 minutes. It is because particles of each metal are set so as to be well bonded to each other and uniformly distributed in the material structure that a particle size of each metal is determined minus 100 meshes.

In the second sintering process, however under a non-oxidizing atmosphere of a vacuum of a pressure of $5\times10^{-5}$ Torr, the fourth embodiment of contact material according to which copper is 50 weight %, molybdenum 45 weight % and chromium 5 weight %, the fifth embodiment thereof according to which copper is 50 weight %, molybdenum 25 weight % and chromium 25 weight %, and the sixth embodiment thereof according to which copper is 50 weight %, molybdenum 5 weight % and chromium 45 weight %, are shaped into contacts in the same manner as those of the first, second and third embodiments of contact material. The same tests were also carried out on the fourth, fifth and sixth embodiments of contact material as on the first, second and third embodiments thereof. The results of the tests will be described. A description of the contact of the fourth embodiment of contact material shall be made and where performances of contacts of the fifth and sixth embodied contact materials are different from those of the contact of the first embodied contact material, the different points shall be specified at a convenient point.

(8) Relatively large current interrupting capability

Current of 11 kArms was interrupted.

(9) Dielectric strength

In accordance with the JEC187 test method, an impulse withstand voltage test was carried out with a 3.0 mm inter-contact gap. Results showed 130 kV against both positive and negative impulses with a scatter of ±10 kV.

After interrupting 11 kArms current, the same impulse withstand voltage test was carried out and showed the same withstand voltage.

After 10,000 times continuously opening and closing a circuit through which 80 Arms relatively small leading current flows, substantially the same impulse withstand voltage test was carried out and showed the same withstand voltage.

(10) Anti-welding capability

The same test was carried out as the test of the item (3), thus resulting in the same.

(11) Relatively small lagging current interrupting capability

The same test was carried out as the test of the item (4), thus resulting in a 4.3 A average current chopping value.

In addition, the averages of current chopping values of the contacts of the fifth and sixth embodied contact materials were 4.0 A (however, $\sigma n = 1.28$ and $n = 100$) and 4.2 A respectively.

(12) Relatively small leading current interrupting capability

The same test was carried out as the test of the item (5), thus resulting in the same.

(13) Electrical conductivity

Percent electrical conductivity (however, with reference to IACS) was between 17 and 45%.

(14) Hardness

Measured under a 1 kgf load, Vickers hardness Hv was between 120 and 210.

The compared results, in the same manner as in the first, second and third embodments of contact material, will be described between the properties of the vacuum interrupter including the pair of the contacts of the fourth embodied contact material and those of the vacuum interrupter including the pair of the same shaped Cu-0.5 Bi contacts. The fourth embodiment of contact material showed the same results as those of the first embodiment of contact material in the points of relatively large current interrupting capability, dielectric strength and relatively small leading current interrupting capability.

On the other hand, the anti-welding capability of the fourth embodiment of contact material amounts to a 70% anti-welding capability of the Cu-0.5 Bi contact. However, such down is not significant actually.

The current chopping value of the contact of the fourth embodied contact material still amounts to between $\frac{1}{3}$ and $\frac{1}{2}$ current chopping value of the Cu-0.5 Bi contact, so that a chopping surge is almost not significant. It is also stable even after many times engaging and disengaging of the contacts for interrupting small lagging current.

The following limits were apparent on a composition ratio of each metal in the contact material by the sintering process.

Below 5 weight % molybdenum significantly increased current chopping value, while above 70 weight % molybdenum lowered relatively large current interrupting capability.

Composition ratios of chromium and copper lead to the same effects as composition ratios of the contact materials by the infiltrating process.

The first sintering process results in lower cost and less down in electrical conductivity of the obtained contact material than the second sintering process.

The second sintering process results in lower porosity of the obtained contact material or voids, so that the amount of occluded gas becomes less to higher mechanical strengths than the first sintering process.

What is claimed is:

1. A contact material of composite metal for a vacuum interrupter consisting essentially of:

a porous matrix containing between 10 and 70 weight % molybdenum powder and between 10 and 70 weight % chromium powder diffused into and bonded to each other, said porous matrix comprising insular particles of said molybdenum and chromium powders bonded to each other by sintering; and between 20 and 70 weight % copper infiltrated into and filling said porous matrix.

2. A contact material as defined in claim 1, wherein the particle size of each of said chromium powder and molybdenum powder is no more than 100 mesh.

3. A contact material as defined in claim 2, wherein said porous matrix consists of nine weight parts of molybdenum powder and one weight part of chromium powder.

4. A contact material as defined in claim 2, wherein said porous matrix consists of four weight parts of molybdenum powder and one weight part of chromium powder.

5. A contact material as defined in claim 2, wherein said porous matrix consists of one weight part of molybdenum powder and one weight part of chromium powder.

6. A contact material as defined in claim 2, wherein said porous matrix consists of one part of molybdenum powder and four parts of chromium powder.

7. A contact material as defined in claim 2, wherein said porous matrix consists of one weight part of molybdenum powder and nine weight parts of chromium powder.

8. A contact material as defined in claim 2, wherein the particle size of each metal powder is no more than 100 mesh.

* * * * *